US005842487A

United States Patent [19]

Ledet

[11] Patent Number: 5,842,487

[45] Date of Patent: Dec. 1, 1998

[54] SELF-CONTAINED TOOTHBRUSH CONSTRUCTION

[76] Inventor: Neil A. Ledet, 15455 Hwy. 190,#88, Covington, La. 70435

[21] Appl. No.: 916,805

[22] Filed: Aug. 22, 1997

[51] Int. Cl.[6] ..... A45D 34/06; A45D 40/24; A46B 11/02

[52] U.S. Cl. ..... 132/308; 132/309; 132/311; 401/17; 401/47; 401/175; 401/195

[58] Field of Search ..... 132/308, 309, 132/311; 401/175, 16, 17, 44, 45, 47, 195

[56] References Cited

U.S. PATENT DOCUMENTS

| | | | |
|---|---|---|---|
| 674,499 | 5/1901 | Eaton, Jr. | 132/308 |
| 1,137,326 | 4/1915 | Jeanne | 401/17 |
| 1,336,390 | 4/1920 | Sargery et al. | 401/175 |
| 1,413,953 | 4/1922 | Appel | 401/45 |
| 1,614,461 | 1/1927 | Doi | 401/22 X |
| 1,619,212 | 3/1927 | Neederman | 132/309 |
| 2,661,870 | 12/1953 | Huenergardt | 401/47 X |
| 3,356,095 | 12/1967 | Tylle | 401/17 X |
| 3,734,106 | 5/1973 | Zimmerman | 132/311 |
| 4,963,046 | 10/1990 | Eguchi | 401/160 |
| 5,144,712 | 9/1992 | Hansel et al. | 15/167.1 |
| 5,297,884 | 3/1994 | Cubillas | 401/268 |
| 5,403,105 | 4/1995 | Jameson | 401/45 |

FOREIGN PATENT DOCUMENTS

| | | | |
|---|---|---|---|
| 2480099 | 10/1981 | France | 132/311 |

*Primary Examiner*—Steven A. Bratlie
*Attorney, Agent, or Firm*—Henderson & Sturm

[57] ABSTRACT

A self-contained toothbrush construction 10 including a handle unit 11, a brush unit 12, and a cap unit 13. The handle unit 11 comprises a hollow housing member 20 including concentric chambers 21, 22. The inner chamber 21 is dimensioned to receive a toothpaste cartridge 50 and the outer chamber 22 forms a reservoir for liquid such as water or mouthwash.

1 Claim, 1 Drawing Sheet

SELF-CONTAINED TOOTHBRUSH CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toothbrush constructions in general, and in particular to a self-contained toothbrush construction which contains a supply of toothpaste for delivery to the toothbrush head element.

2. Description of Related Art

As can be seen by reference to the following U.S. Pat. Nos. 4,963,046; 5,144,712; 5,297,884; and 5,403,105, the prior art is replete with myriad and diverse toothbrush constructions containing a supply of toothpaste and a delivery system for supplying toothpaste to the bristles of the toothbrush.

While all of the aforementioned prior art constructions are more than adequate for the basic purpose and function for which they have been specifically designed, they are uniformly deficient with respect to their failure to provide a simple, efficient and practical self-contained toothbrush construction that can be employed away from any readily available source of drinking water or the like.

As most user's of self-contained toothbrushes are aware, their use is normally restricted to a location that has a readily available source of water, or the user must rely on the moisture content within the toothpaste to liquify the toothpaste to an acceptable degree.

As a consequence of the foregoing situation, there has existed a longstanding need for a new and improved self-contained toothbrush construction that has a separate liquid reservoir to facilitate the brushing, rinsing, or freshening of the user's teeth and mouth during oral hygiene procedures, and the provision of such a construction is a stated objective of the present invention.

BRIEF SUMMARY OF THE INVENTION

Briefly stated, the self-contained toothbrush construction that forms the basis of the present invention comprises a handle unit, a brush unit and a cap unit wherein the handle unit comprises means for feeding toothpaste from a central reservoir through the hollow stem of the brush unit and into the bristle of the brush head element.

As will be explained in greater detail further on in the specification, the main feature of novelty embodied in this invention revolves around the fact that the handle unit comprises a housing member having inner and outer concentric chambers wherein the inner chamber forms a reservoir for toothpaste, dentifrice, etc. and the outer chamber forms a reservoir for a liquid such as water or mouthwash that may be used during or subsequent to the brushing process.

In addition, the outer periphery of the housing member is provided with a flat recessed portion that receives a mirror element that may also be employed for hygienic purposes.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
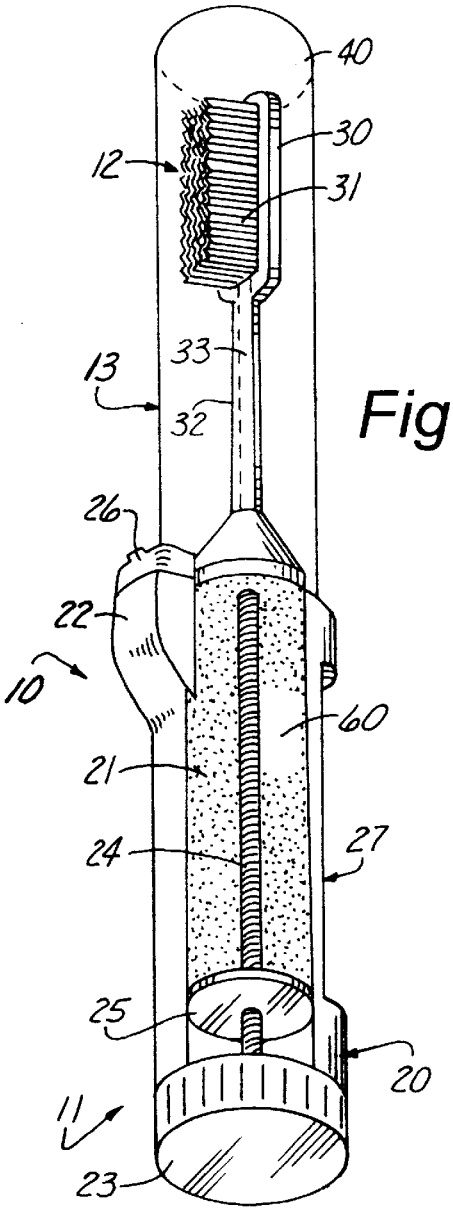
FIG. 1 is a perspective view of the self-contained toothbrush construction that forms the basis of the present invention.

As can be seen by reference to the drawings, and in particularly to FIG. 1, the self-contained toothbrush construction that forms the basis of the present invention is designated generally by the reference number 10. The construction 10 comprises in general, a handle unit 11, a brush unit 12, and a cap unit 13. These units will now be described in seriatim fashion.

Figure 2:
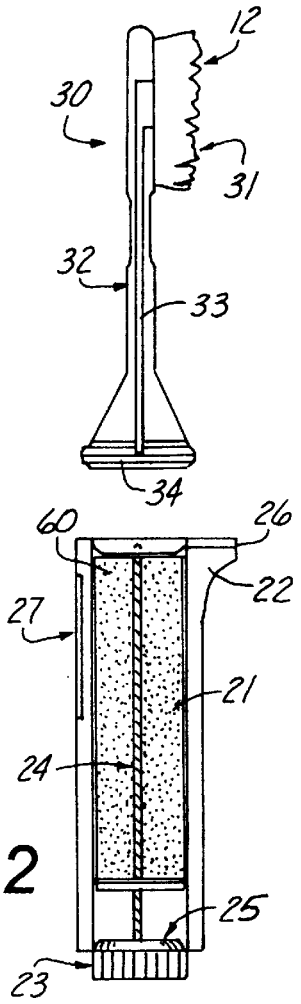
FIG. 2 is an exploded perspective view of the toothbrush construction.

As shown in FIGS. 1 and 2, the handle unit 11 comprises a dual chamber hollow handle member 20 having an open-ended inner chamber 21 and closed end outer chamber 22 concentric chambers wherein the open-ended inner chamber 21 forms a reservoir for toothpaste, dentrifice, or the like and the closed end outer chamber 22 forms a reservoir for a liquid such as water, mouthwash, or the like.

In addition, the outboard end of the handle member 20 is provided with a rotatable cap member 23 having an elongated threaded stem 24 which extends a substantial distance within the open-ended inner chamber 21 and is threadably engaged with a disk element 25 movably received and frictionally engaged within the inner chamber 21.

Still referring to FIGS. 1 and 2, it can be seen that the inboard end of the inner chamber 21 is threaded to receive one end of the brush unit 12, and the inboard end of the outer chamber 22 is provided with a closure element 26 which projects outwardly from, and controls the flow of fluid from within the outer chamber 22 in a well recognized fashion.

Figure 3:
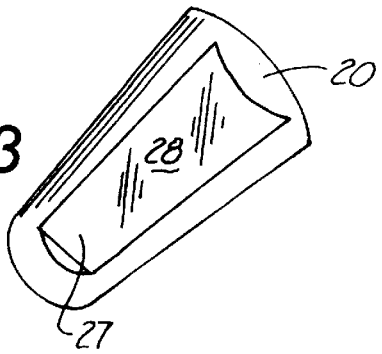
FIG. 3 is an isolated detail view of the mirror element.

As can also be seen by reference to FIGS. 1 through 3, the exterior of the housing member 20 is further provided with a generally flat recessed portion 27 which contains a mirror element 28.

Returning once more to FIGS. 1 and 2, it can be seen that the brush unit 12 comprises in general, a brush member 30, including a brush head element 31 mounted on one end of a hollow stem 32 having an internal passageway 33 that extends from the brush head element 31 to the other end 34 of the stem 32 which is threaded for engagement with the periphery of the inner chamber 21 in a well recognized fashion.

In addition, as shown in FIG. 1, the cap unit 13 comprises an elongated clear plastic cylindrical cap member 40 which serves the dual function of providing a protective cap for the brush unit 12 when not in use, as well as providing a drinking receptacle for receiving the fluid contents of the outer chamber 22 of the housing member 20 either for the purpose of rinsing the user's teeth or gargling mouthwash or the like.

Figure 4:
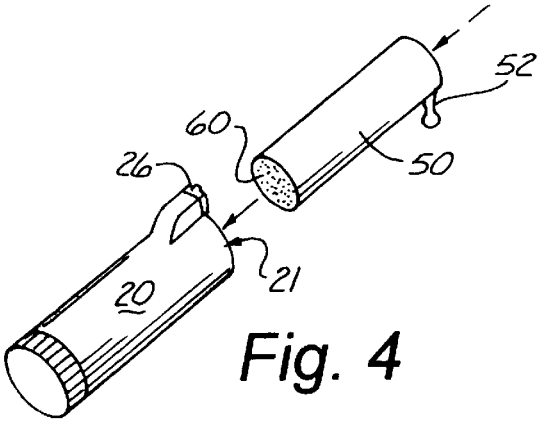
FIG. 4 is an isolated exploded perspective view of the engagement between the toothpaste cartridge and the handle unit.

Turning now to FIG. 4, it can be seen that the inner chamber 21 of the housing member 20 is dimensioned to receive a toothpaste cartridge 50 having a sealed end 51 controlled by a foil tab 52. The cartridge 50 is inserted into the interior chamber 21 and prior to use the foil tab would be removed so that the disk 25 can push the mass of toothpaste 60 through the passageway 33 of the stem 32 and into the brush head element 31.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A self-contained toothbrush construction wherein the construction consists of:

a handle unit including a housing member having inner and outer concentric chambers wherein the inner chamber forms a reservoir for toothpaste and the outer chamber forms a reservoir for liquid; and is provided with a closure element which projects outwardly from one side of the outer chamber and wherein, the housing member is provided with a generally flat recessed portion that contains a mirror element;

a toothpaste cartridge dimensioned to be received in said inner chamber wherein at least one end of the toothpaste cartridge is provided with a foil tab;

a brush unit operatively associated with the handle unit and comprising a hollow brush member having one end in fluid communication with said inner chamber; wherein said brush member comprises a hollow stem having a brush head element on one end wherein the other end is engageable with the inner chamber in the housing member, and wherein said hollow stem has an internal passageway extending from said brush head element to said other end;

a cap unit including an elongated cylindrical cap member dimensioned to receive said brush unit; and means for forcing toothpaste from said inner chamber through said hollow brush member.

* * * * *